US008158898B2

(12) United States Patent
Park

(10) Patent No.: US 8,158,898 B2
(45) Date of Patent: Apr. 17, 2012

(54) ELASTIC PRESSING UNIT AND MOLDED CASE CIRCUIT BREAKER HAVING THE SAME

(75) Inventor: Ki Eok Park, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 323 days.

(21) Appl. No.: 12/633,827

(22) Filed: Dec. 9, 2009

(65) Prior Publication Data

US 2010/0163385 A1 Jul. 1, 2010

(30) Foreign Application Priority Data

Dec. 31, 2008 (KR) ..... 10-2008-0138516

(51) Int. Cl.
*H01H 75/00* (2006.01)
*H01H 77/00* (2006.01)
*H01H 83/00* (2006.01)

(52) U.S. Cl. ..... 200/244; 200/50.32; 200/50.37; 200/17 R; 335/6; 335/8

(58) Field of Classification Search ..... 200/17 R, 200/400, 401, 50.32–50.4, 244; 335/6–11, 335/21, 23, 166–175
See application file for complete search history.

(56) References Cited

U.S. PATENT DOCUMENTS

| | | | | |
|---|---|---|---|---|
| 6,545,584 | B2 * | 4/2003 | Turner | 337/38 |
| 6,617,533 | B1 * | 9/2003 | Lawson et al. | 200/50.32 |
| 6,787,725 | B2 | 9/2004 | Kim et al. | |
| 6,884,949 | B2 | 4/2005 | Yoon | |
| 7,227,279 | B2 | 6/2007 | Kim | |
| 7,474,179 | B2 * | 1/2009 | Weister et al. | 335/15 |
| 7,515,022 | B2 * | 4/2009 | Zindler | 335/6 |
| 7,538,644 | B2 * | 5/2009 | Oh | 335/8 |
| 7,541,899 | B2 * | 6/2009 | Ahn | 335/8 |
| 7,569,784 | B2 * | 8/2009 | Rakus et al. | 200/244 |
| 2004/0000469 | A1 * | 1/2004 | Gibson et al. | 200/400 |
| 2007/0075808 | A1 * | 4/2007 | Ahn | 335/6 |
| 2008/0210532 | A1 * | 9/2008 | Besana et al. | 200/244 |
| 2011/0132733 | A1 * | 6/2011 | An | 200/17 R |

FOREIGN PATENT DOCUMENTS

KR 92-008726 10/1992

OTHER PUBLICATIONS

U.S. Appl. No. 12/633,863 to Kim et al., filed Dec. 9, 2009.

(Continued)

*Primary Examiner* — Michael Friedhofer
(74) *Attorney, Agent, or Firm* — Greenblum & Bernstein P.L.C.

(57) ABSTRACT

Disclosed are an elastic pressing unit and a molded case circuit breaker having the same, the molded case circuit breaker including, a plurality of fixed contacts, a plurality of movable contacts disposed to be rotatable between a closing position contacted with the corresponding fixed contacts and a breaking position or trip position separated from the corresponding fixed contacts, a rotation pin disposed to be simultaneously connected to the movable contacts, a mechanical unit connected to the rotation pin so as to allow the movable contacts to be simultaneously rotatable, and an elastic pressing unit configured to apply an elastic force to the rotation pin such that the rotation pin is rotated toward the closing position, whereby component deformation can be prevented, resulting in ensuring operation reliability and stability of the mechanical unit.

17 Claims, 9 Drawing Sheets

OTHER PUBLICATIONS

U.S. Appl. No. 12/635,911 to Woo, filed Dec. 11, 2009.
U.S. Appl. No. 12/641,769 to Kim, filed Dec. 18, 2009.
U.S. Appl. No. 12/641,946 to Seo, filed Dec. 18, 2009.
U.S. Appl. No. 12/645,783 to Kim, filed Dec. 23, 2009.
U.S. Appl. No. 12/645,620 to Kim et al., filed Dec. 23, 2009.
U.S. Appl. No. 12/651,501 to Tak et al., filed Jan. 4, 2010.
Korean Office Action that issued with respect to Korean Patent Application No. 10-2008-0138516, mailed on Sep. 29, 2010.

* cited by examiner

ELASTIC PRESSING UNIT AND MOLDED CASE CIRCUIT BREAKER HAVING THE SAME

CROSS-REFERENCE TO A RELATED APPLICATION

Pursuant to 35 U.S.C. §119(a), this application claims the benefit of earlier filing date and right of priority to Korean Application No. 10-2008-0138516, filed on Dec. 31, 2008, the contents of which is incorporated by reference herein in its entirety.

BACKGROUND OF THE INVENTION

1. Field of the Invention

The present invention relates to an elastic pressing unit and a molded case circuit breaker having the same, and particularly, to an elastic pressing unit capable of preventing deformation of a component and thus avoiding a loose (poor) contact between contacts due to the deformation, and a molded case circuit breaker having the same.

2. Background of the Invention

In general, a molded case circuit breaker is installed at a switch board or the like so as to serve as a switching mechanism for supplying or cutting off power toward a load side in a no load condition. During the use of load, if a high current exceeding a load current flows due to an abnormal occurrence in a load current path, the molded case circuit breaker serves to supply power from a power source side to a load side or block such power, for the purpose of protecting wires of the load current path or load side components.

FIG. 1 is a disassembled perspective view of a molded case circuit breaker according to the related art, FIG. 2 is a perspective view showing an inside of unipolar blocking units of FIG. 1, and FIG. 3 is a perspective view showing an operation of a rotation pin of FIG. 1. As shown in FIGS. 1 to 3, a molded case circuit breaker includes a plurality of unipolar blocking units 110 configured to control each phase current and having a movement route for allowing an arc pressure to be moved therealong, a mechanical unit 140 configured to operate the unipolar blocking units 110 according to a user's manipulation or by means of a trip mechanism (not shown), and a rotation pin 150 simultaneously coupled to each of movable contacts 131 of the unipolar blocking units 110 so that the movable contacts 131 can be moved at the same time and configured to transfer a driving force of the mechanical unit 140 to each unipolar blocking unit 110.

Each unipolar blocking unit 110 may be provided with a frame 111, a fixed is contact 121 fixed to the frame 111, and a movable contact 131 coupled to the frame 111 to be rotatable from the fixed contact 121. Here, the fixed contact 121 and the movable contact 131 may be configured to have a current limitation performance.

Each movable contact 131 may be rotated centering around a rotation shaft 135, which is rotatably supported at the frame 111. The rotation pin 150 may be coupled to one side of the rotation shaft 135 of the movable contact 131 in parallel to the rotation shaft 135.

The mechanical unit 140 may be configured as a plurality of links and springs (not shown) for generating a driving force applied when the movable contact 131 and the fixed contact 121 are contacted with or separated from each other. A handle 145 for allowing the user's manipulation may be connected to one side, namely, an upper side of the mechanical unit 140. The mechanical unit 140 is connected to the handle 145 and a trip mechanism. Accordingly, the contact or separation between the movable contact 131 and the fixed contact 121 are enabled by the handle 145 manipulated by the user or by means of the trip mechanism.

In the meantime, the unipolar blocking units 110 may be provided in the same number (e.g., three or four unipolar blocking units) as the number of phases. Here, the rotation pin 150 may have a length long enough to be simultaneously coupled to the movable contacts 131 of the unipolar blocking units 110 depending on the number of installed unipolar blocking units 110.

With such configuration, when the handle 145 is moved to a closing position, the rotation pin 150 is rotated by the driving force of the mechanical unit 140, and each movable contact 131 of the unipolar blocking units 110 is simultaneously rotated to the closing position responsive to the rotation of the rotation pin 150. Here, when the movable contact 131 comes in contact with the fixed contact 121, an electric repulsive force is applied between the fixed contact 121 and the movable contact 131. Here, since the driving force of the mechanical unit 140 is greater than the electric repulsive force, the movable contact 131 comes in contact with the fixed contact 121, thereby being able to apply an electric current.

However, in the related art molded case circuit breaker, upon a closing operation, the driving force of the mechanical unit 140 and the electric repulsive force of each unipolar blocking unit 110 are applied to the rotation pin 150 simultaneously in opposite directions. Accordingly, the rotation pin 150 may be deformed. In particular, since the mechanical unit 140 is disposed approximately at a middle portion of the rotation pin 150, the deformation of the rotation pin 150 may occur more severely at a portion (area) of the rotation pin 150 coupled to a unipolar blocking unit 110 disposed far away from the mechanical unit 140 than at a portion thereof coupled to a unipolar blocking unit 110 disposed close to the mechanical unit 140. When the deformation of the rotation pin 150 occurs, the movable contact 131 and the fixed contact 121 of the unipolar blocking unit 110, disposed at the deformed area of the rotation pin 150, may not be contacted with each other by a sufficient contact pressure, which may cause a current to be applied unstably.

SUMMARY OF THE INVENTION

Therefore, to solve the problems of the related art, an object of the present invention is to provide an elastic pressing unit capable of ensuring operation reliability and stability of an operation mechanical unit by preventing the deformation of a component, and a molded case circuit breaker having the same.

Another object of the present invention is to provide an elastic pressing unit capable of achieving a stably contacted state between contacts by increasing a contact pressure between a fixed contact and a movable contact, and a molded case circuit breaker having the same.

Another object of the present invention is to provide an elastic pressing unit capable of implementing a simple structure and an easy installation, and a molded case circuit breaker having the same.

To achieve these and other advantages and in accordance with the purpose of the present invention, as embodied and broadly described herein, there is provided a molded case circuit breaker having an elastic pressing unit, the circuit breaker including, a plurality of fixed contacts, a plurality of movable contacts disposed to be rotatable between a closing position contacted with the corresponding fixed contacts and a breaking position or trip position separated from the corresponding fixed contacts, a rotation pin disposed to be simultaneously connected to the movable contacts; a mechanical unit connected to the rotation pin so as to allow the movable contacts to be simultaneously rotatable, and an elastic pressing unit configured to apply an elastic force to the rotation pin such that the rotation pin is rotated toward the closing position.

Here, the elastic pressing unit may include a pusher configured to press the rotation pin, and a spring configured to apply an elastic force to the pusher such that the pusher is contactable with the rotation pin.

The spring may be a compression spring disposed at a rear side of the pusher.

The elastic pressing unit may further include a body configured to slidably support the pusher.

The body may be provided with an accommodation space, and the pusher may be protruded from and retracted into the accommodation space.

The elastic pressing unit may further include guide pins coupled to the body and configured to not only slidably guide the pusher but also prevent the separation of the pusher.

The pusher may be disposed above the closing position of the rotation pin.

The pusher may be provided with a cut-off portion, cut out to correspond to a rotation route of the rotation pin.

A contact portion may be formed at one side of the cut-off portion, in a manner of cutting out the one side to correspond to the shape of the rotation pin so as to be contactable with the rotation pin.

The elastic pressing unit may be configured as a spring.

The spring may be a tension spring having one side connected to the rotation pin and another side fixed to a fixed component.

The spring may be disposed at each of both end portions of the rotation pin.

The fixed contacts and the movable contacts may implement unipolar to blocking units, each disposed by each phase.

The elastic pressing unit may be disposed at a unipolar blocking unit located the farthest away from the mechanical unit.

In one aspect of the present invention, there is provided an elastic pressing unit including, a body, a pusher coupled to be protruded from or retracted in the body, and a spring configured to apply an elastic force to the pusher so that the pusher is protruded, wherein the pusher is disposed to press a rotation pin in a direction that a plurality of movable contacts disposed in a shaft direction with a gap therebetween are contactable with fixed contacts, the rotation pin simultaneously coupled to the plurality of movable contacts.

Here, the elastic pressing unit may further include guide pins coupled to the body through the pusher and configured to not only guide the pusher but also prevent the separation of the pusher.

The body may be provided with a plurality of coupling pieces protruded to be inserted into a frame of a unipolar blocking unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Figure 1:
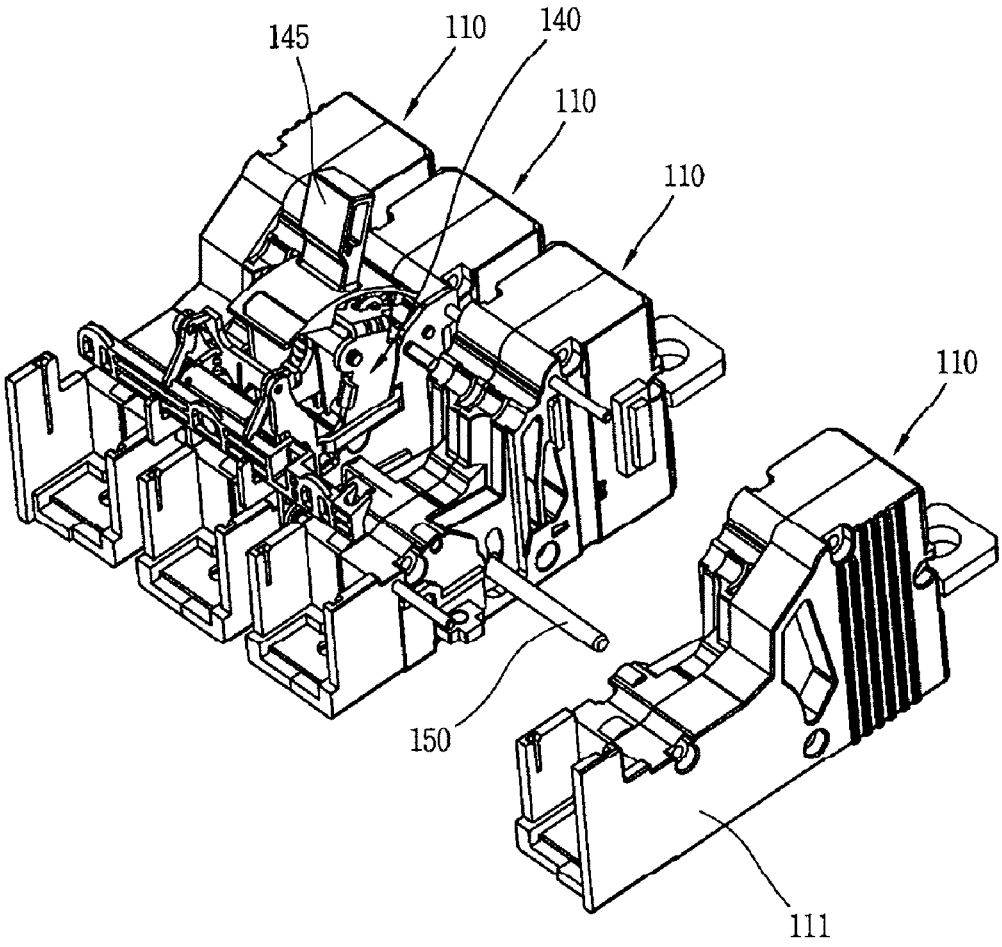
FIG. 1 RELATED ART
FIG. 1 is a disassembled perspective view showing a molded case circuit breaker according to the related art.
Figure 2:
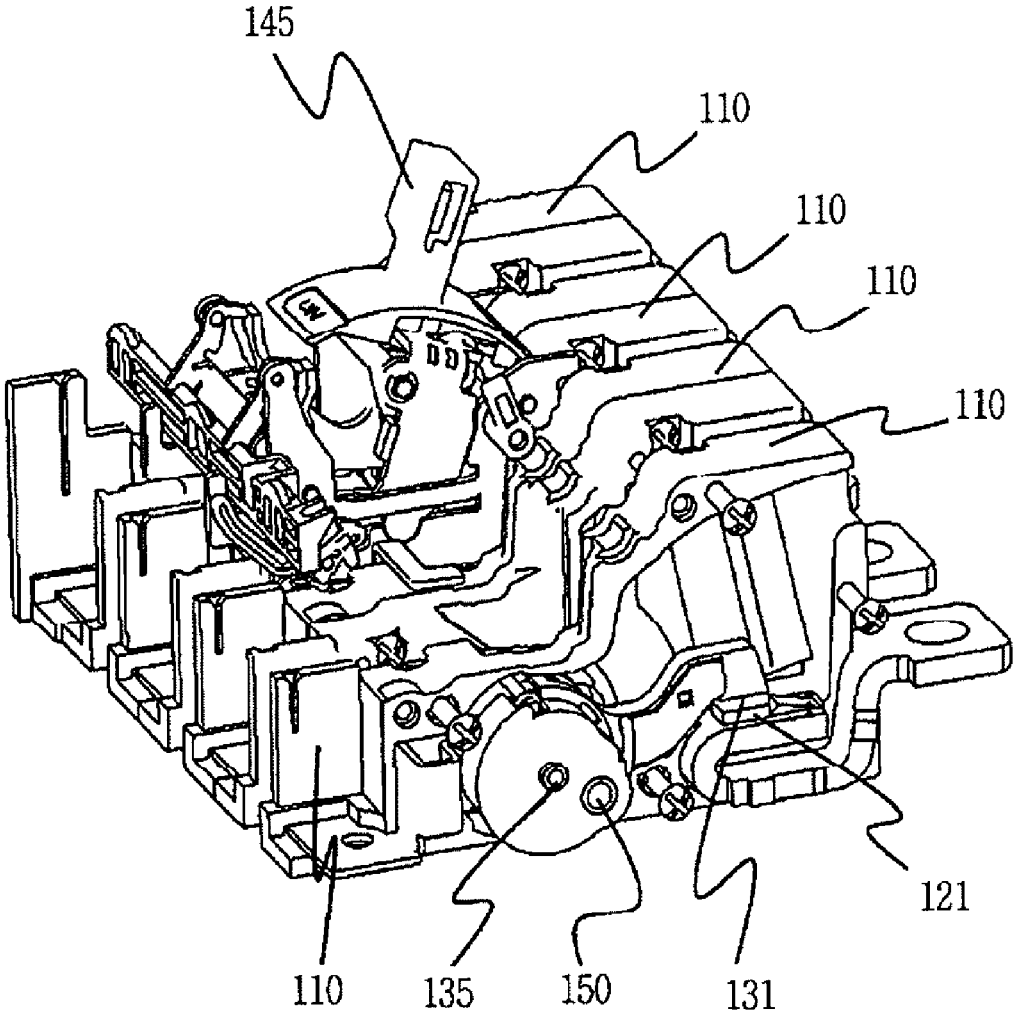
FIG. 2 RELATED ART
FIG. 2 is a perspective view showing an inside of unipolar blocking units of FIG. 1.
Figure 3:
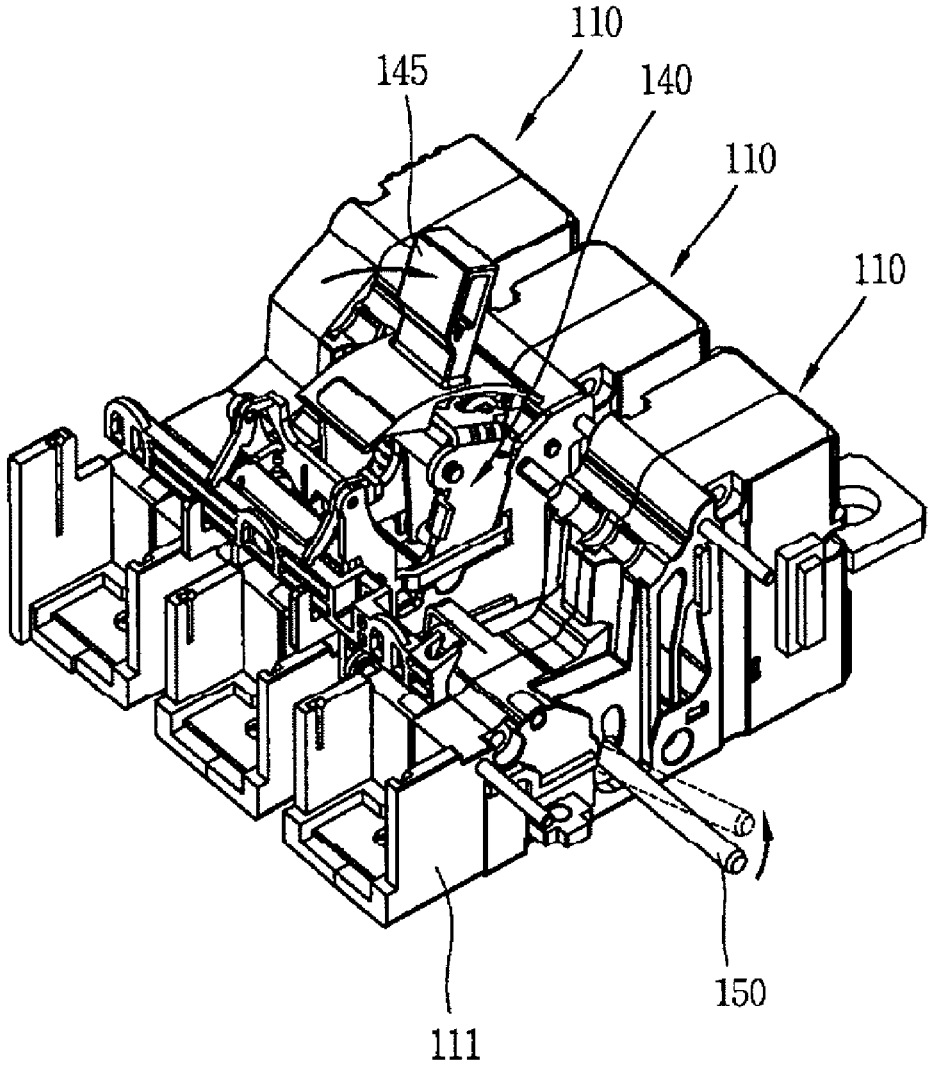
FIG. 3 RELATED ART
FIG. 3 is a perspective view showing an operation of a rotation pin of FIG. 1.
Figure 4:
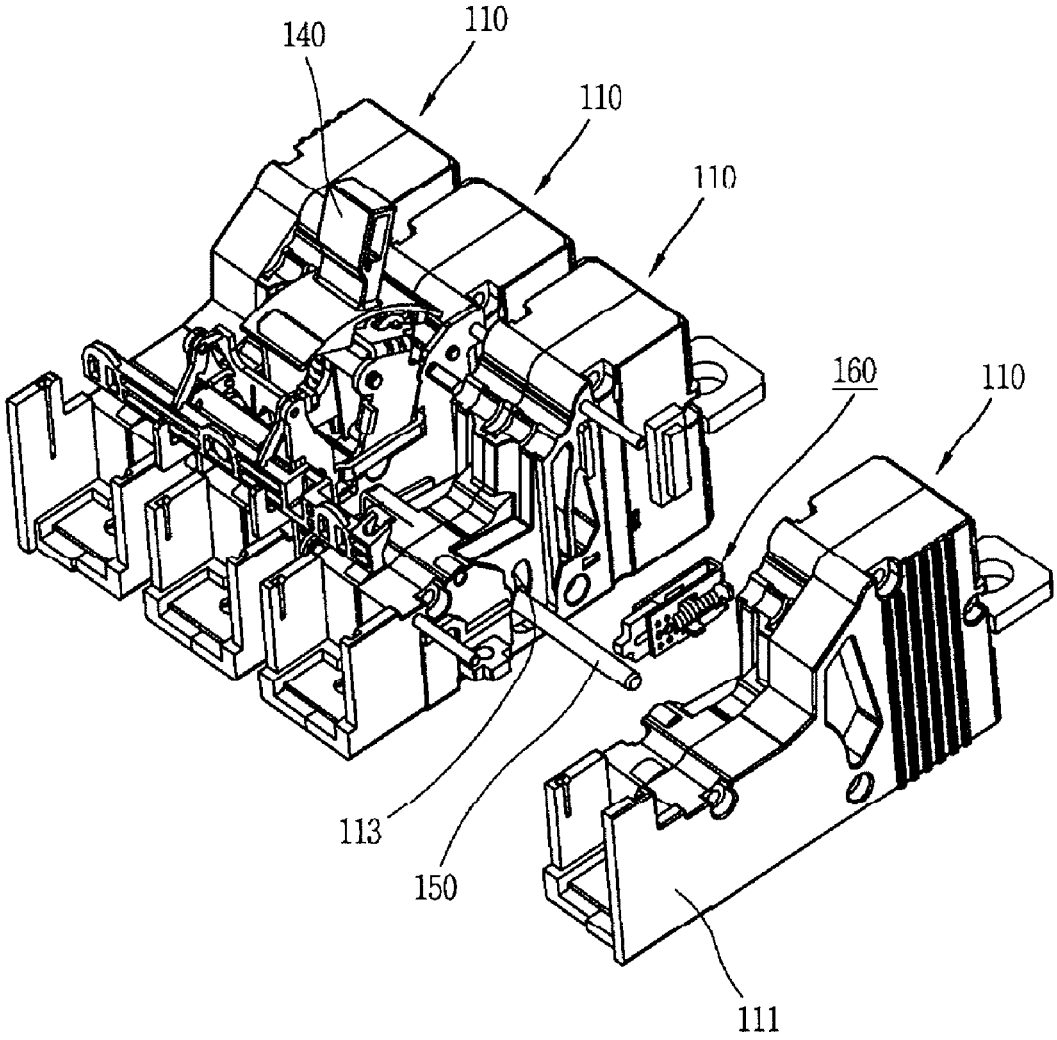
FIG. 4 is a disassembled perspective view of a molded case circuit breaker having an elastic pressing unit in accordance with one embodiment of the present invention.
Figure 5:
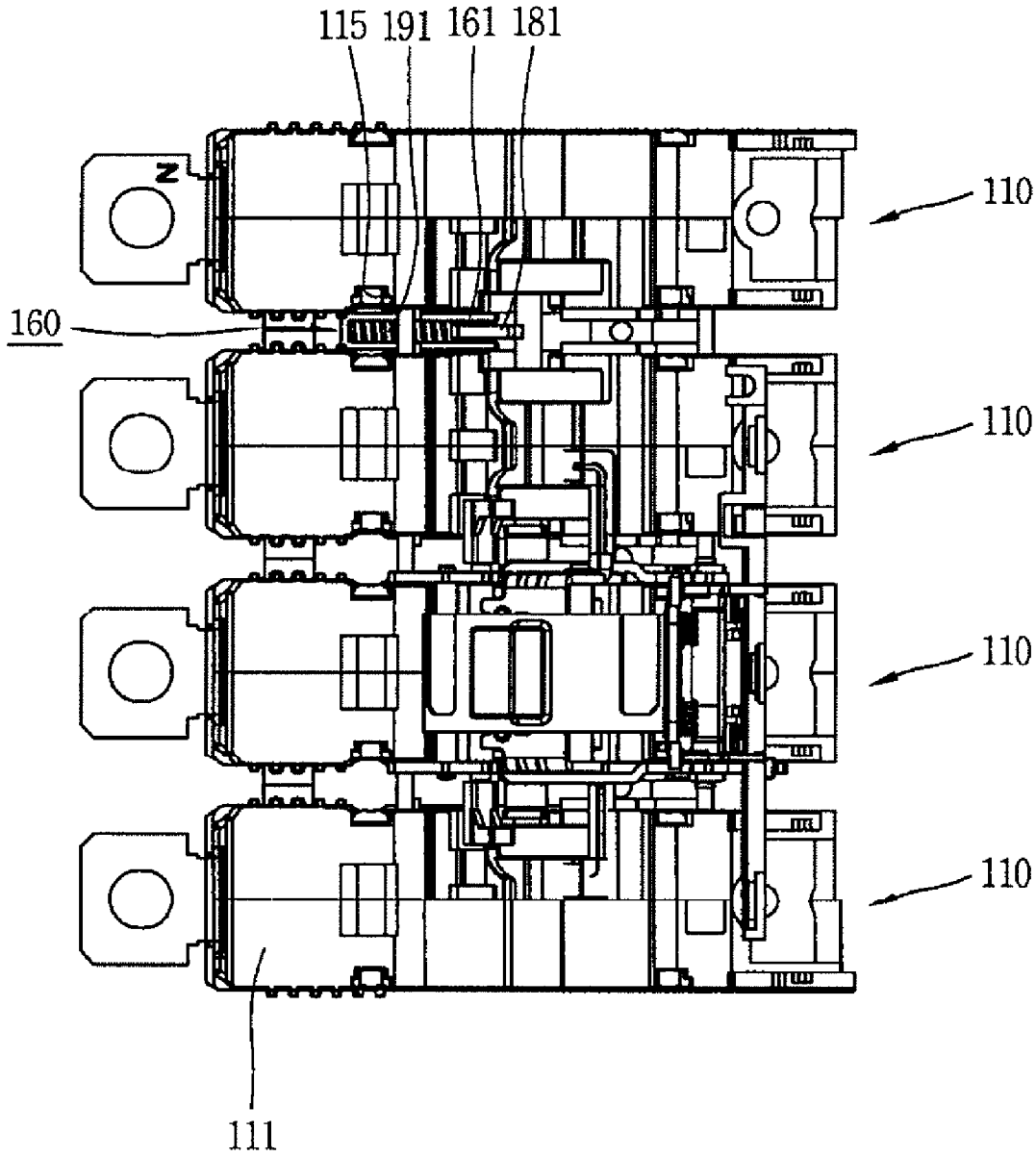
FIG. 5 is a planar view showing a coupled state of FIG. 4.
Figure 6:
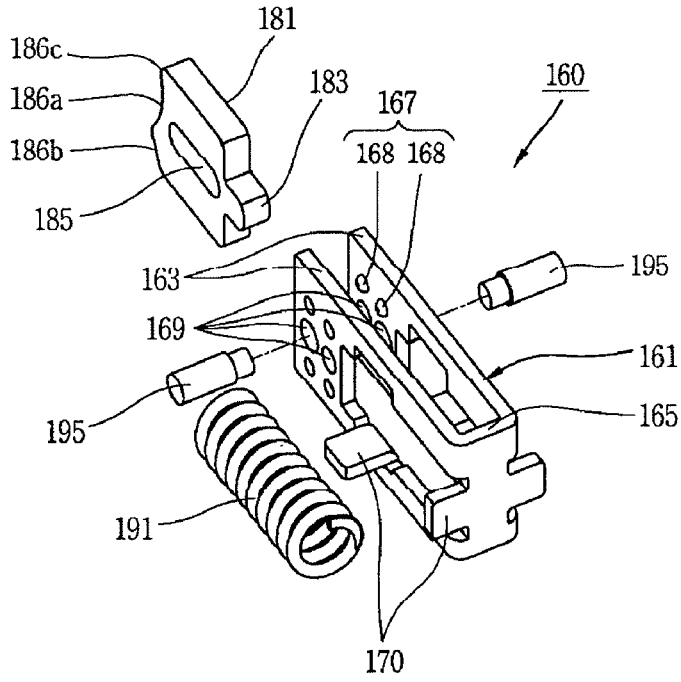
FIG. 6 is a disassembled perspective view of an elastic pressing unit in accordance with one embodiment of the present invention.
Figure 7:
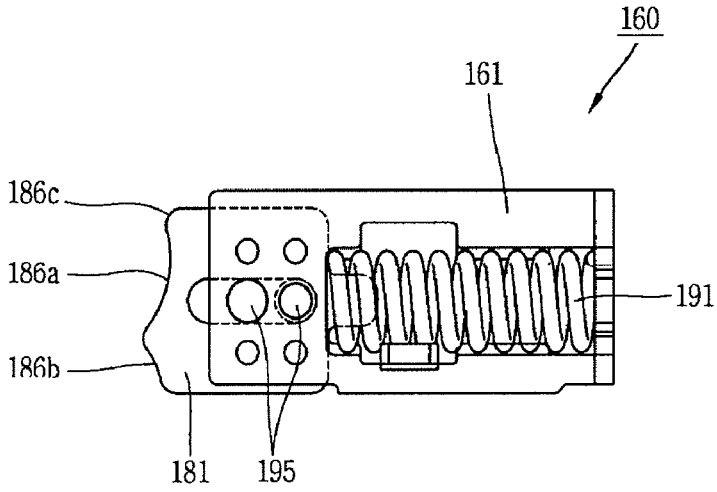
FIG. 7 is a side view showing a coupled state of the elastic pressing unit of FIG. 6.
Figure 8:
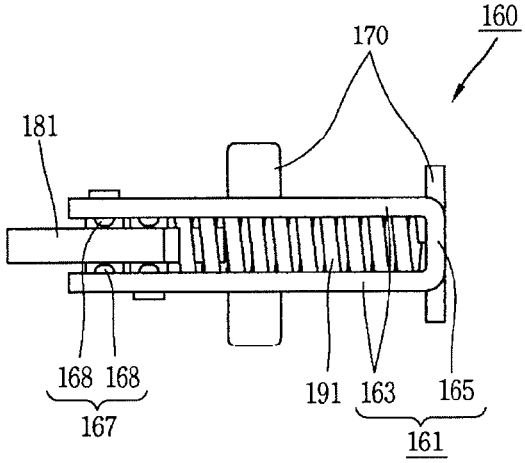
FIG. 8 is a planar view showing the coupled state of the elastic pressing unit of FIG. 6.
Figure 9:
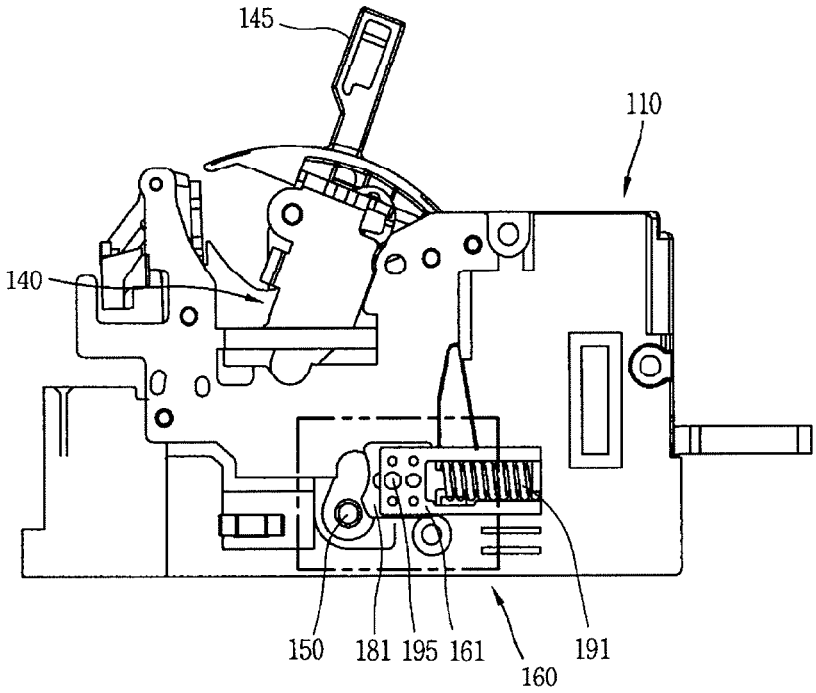
FIG. 9 is a side view of an installed state of the elastic pressing unit of FIG. 6.
Figure 10:
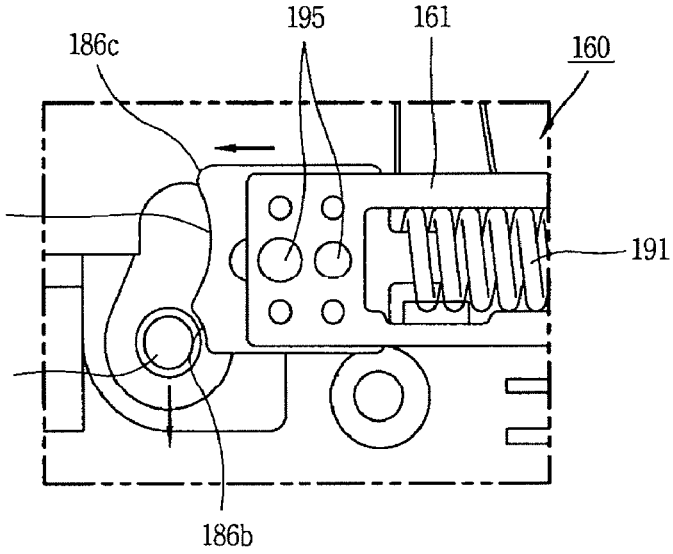
FIG. 10 is a main part enlarged view of the elastic pressing unit of FIG. 9.
Figure 11:
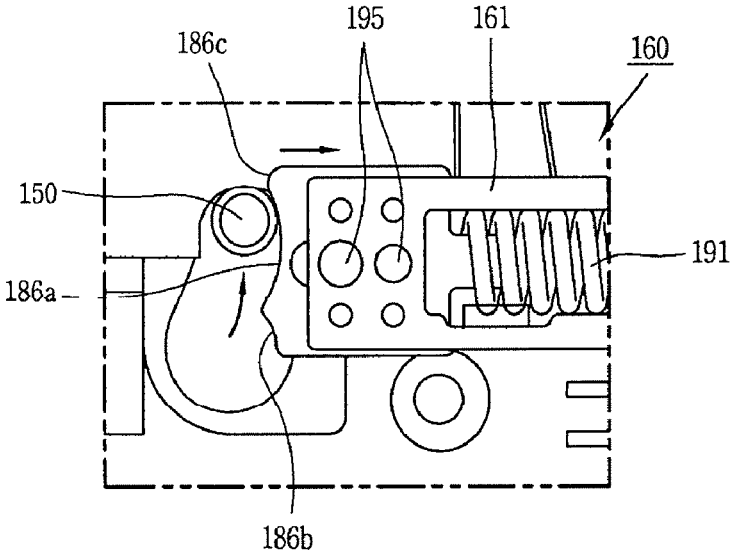
FIG. 11 is a view showing an operation of the elastic pressing unit of FIG. 9.

FIG. 4 is a disassembled perspective view of a molded case circuit breaker having an elastic pressing unit in accordance with one embodiment of the present invention, FIG. 5 is a planar view showing a coupled state of FIG. 4, FIG. 6 is a disassembled perspective view of an elastic pressing unit in accordance with one embodiment of the present invention, FIG. 7 is a side view showing a coupled state of the elastic pressing unit of FIG. 6, FIG. 8 is a planar view showing the coupled state of the elastic pressing unit of FIG. 6, FIG. 9 is a side view of an installed state of the elastic pressing unit of FIG. 6, FIG. 10 is a main part enlarged view of the elastic pressing unit of FIG. 9, and FIG. 11 is a view showing an operation of the elastic pressing unit of FIG. 9. Hereinafter, the same or equivalent configuration to the aforementioned configuration will not be shown again in the drawings for the sake of brief explanation, and will have the same reference numerals.

As shown in FIGS. 4 and 5, a molded case circuit breaker having an elastic pressing unit according to the present invention may include a plurality of fixed contacts 121, a plurality of movable contacts 131 disposed to be rotatable between a closing position contacted with corresponding fixed contacts 121 and a breaking position (or a trip position) separated from the corresponding fixed contacts 121, a rotation pin 150 simultaneously connected to the movable contacts 131, a mechanical unit 140 connected to the rotation pin 150 for allowing the movable contacts 131 to be simultaneously rotated, and an elastic pressing unit 160 for applying an elastic force to the rotation pin 150 to be rotated to the closing position.

Here, the fixed contact 121 and the movable contact 131 are disposed as a pair to be contacted with or separated from each other, so as to control each phase current. The pair of fixed contact 121 and movable contact 131 may be defined as a unipolar blocking unit 110. The unipolar blocking units 110 may be disposed in parallel in correspondence with the number of phases. This embodiment illustrates 4 unipolar blocking units 110 corresponding to four phases.

Each of the unipolar blocking units 110 may further include a frame 111 for accommodating the fixed contact 121 and the movable contact 131. A route of an arc pressure, which is generated upon contacting or separating the fixed contact 121 and the movable contact 131 with or from each other, may be formed in the frame 111.

The movable contact 131 may be rotatable between the closing position and a trip position based upon a rotation shaft 135, rotatably supported at the frame 111.

The movable contacts 131 of the unipolar blocking units 110 may be connected all together by the rotation pin 150 so as to be simultaneously rotatable between the closing position and the trip position. The rotation pin 150 may simultaneously connected to one side of the rotation shaft 135 of each movable contact 131. Each unipolar blocking unit 110 may be provided with a slot 113 matching with a rotation track of the rotation pin 150 so as to allow the rotation of the rotation pin 150. The slot 113 may be formed in an arcuate shape.

A mechanical unit 140 may be disposed at one of the unipolar blocking units 110 disposed in parallel. The mechanical unit 140 is configured to move the rotation pin 150 such that the movable contact 131 and the fixed contact 121 of each unipolar blocking unit 110 can be contacted with or separated from each other by a user's manipulation or by means of a trip mechanism (not shown). In this embodiment, the mechanical unit 140 is disposed at the second unipolar blocking unit 110 from the left side of FIG. 4.

The mechanical unit 140 may be configured by combination of plurality of links (not shown) cooperatively connected together and springs (not shown) for applying an elastic force to the links. A handle 145 may be rotatably disposed at an upper side of the mechanical unit 140. Accordingly, each unipolar blocking unit 110 may be operated to the closing position or the trip position by the user's manipulation.

A trip mechanism (not shown) may be connected to one side of the mechanical unit 140 so as to detect a high current, such as a fault current or the like, and then cut off such current. Accordingly, when a high current such as the fault current or the like is applied, the trip mechanism detects such current and operates the mechanical unit 140. The movable contacts 131 are accordingly separated from the corresponding fixed contacts 121, thereby performing a trip operation for cutting off the fault current.

In the meantime, the elastic pressing unit 160 for applying an elastic force to the rotation pin 150 may be disposed at one side of the rotation pin 150. The elastic pressing unit 160 may be employed to prevent deformation of the rotation pin 150 due to an electric repulsive force by pressing the rotation pin 150 in a reverse direction to the electric repulsive force being applied, responsive to the electric repulsive force applied between the fixed contacts 121 and the movable contacts 131 upon closing the unipolar blocking units 110.

The elastic pressing unit 160 may be disposed at a unipolar blocking unit 110 located far away from the mechanical unit 140. This embodiment illustrates that the elastic pressing unit 160, as shown in FIGS. 4 and 5, is disposed between the third unipolar blocking unit 110 and the fourth unipolar blocking unit 110 from the left side of FIG. 4. That is, since the deformation of the rotation pin 150 occurs relatively severely at the coupled portion (area) with the fourth unipolar blocking unit 110, which is disposed the farthest away from a portion (area) of the rotation pin 150, to which the driving force of the mechanical unit 140 is applied, the elastic pressing unit 160 may be disposed to compensate the condition, resulting in effectively preventing the deformation of the rotation pin 150.

Hereinafter, description will be given of an elastic pressing unit in accordance with one embodiment of the present invention with reference to FIGS. 6 to 11.

Referring to FIGS. 6 to 11, the elastic pressing unit 160 may include a pusher 181 contactable with the rotation pin 150, and a pusher spring 191 for applying an elastic force to the pusher 181. The elastic pressing unit 160 may further include a body 161 for supporting the pusher 181.

The body 161 may be provided with side plate portions 163 disposed at both sides of the pusher 181, and a connection portion 165 for connecting the both side plate portions 163. The body 161 may be formed in a shape similar to a 'U' like section.

The pusher 181 may be formed in a plate shape. A protrusion 183 to be inserted into the pusher spring 191 may be formed at one side of the pusher 181.

The pusher spring 191 may be implemented as a compression coil spring to be expanded and contracted in a motion direction of the pusher 181. The pusher spring 191 may be formed to have appropriate elastic force and size taking into account of the electric repulsive force between the fixed contact 121 and the movable contact 131 and the driving force of the mechanical unit 140.

The pusher 181 may be installed within the body 161 to be movable in and out via an open area of the body 161. The pusher spring 191 may be disposed at a rear side of the pusher 181.

The body 161 may be provided with guide pins 195 configured to not only guide protruding and withdrawing of the pusher 181 but also prevent the separation of the pusher 181 from the body 161. The guide pins 195 may be formed as a pair. Coupling holes 169 into which the guide pins 195 are coupled may be formed at the body 161.

In correspondence with this configuration, the pusher 181 may be provided with a pin hole 185 formed, like a long slot, through the pusher 181, for allowing the pusher 181 to be relatively movable in a coupled state to the guide pin 195.

Meanwhile, the elastic pressing unit 160, as shown in FIGS. 9 to 11, may be disposed such that its center can be located higher than the center of the rotation pin 150 when the rotation pin 150 is located at the closing position, so as to press the rotation pin 150. Accordingly, a cut-off portion **186*a* may be formed by cutting off a protruded end portion of the pusher 181. The cut-off portion 186*a* may be pressed by the rotation pin 150 when the rotation pin 150 is rotated from the trip position to the closing position, thereby allowing the pusher 181 to be retracted. The cut-off portion 186*a* may be formed in an arcuate shape, curved inwardly to correspond to the rotation tract of the rotation pin 150**.

A contact portion **186*b*, which is contactable with the rotation pin 150 when the rotation pin 150 is located at the closing position, may be formed at an end of the pusher 181, namely, at a lower side of the cut-off portion 186*a*. The contact portion 186*b* is formed in an arcuate shape recessed inwardly to correspond to a circumference of the rotation pin 150. Here, the contact portion 186*b* may be configured to come in contact with the rotation pin 150 before a portion where an electric repulsive force is generated and applied due to the approach of the movable contact 131 toward the corresponding fixed contact 121. Accordingly, the rotation pin 150 is downwardly pressed against the electric repulsive force, by which the rotation pin 150 is upwardly pressed, thereby preventing the rotation pin 150 from being deformed. A guide portion 186*c* may be formed at an upper side of the cut-off portion 186***a* for allowing a smooth contact with the rotation pin 150. The guide portion 186*c* may be formed with a circular outer surface.

A slide supporting portion 167 for slidably supporting the pusher 181 may be formed at the body 161. The slide supporting portion 167 may be implemented as a plurality of protrusions 168 protruding from the both side plate portions 163 of the body 161 to come in contact with the pusher 181, thereby reducing a contact area of the pusher 181 and also effectively preventing a clearance from being generated in a horizontal direction of the pusher 181. The body 161 may be formed of a metal. The protrusion 168 may be formed in an embossing shape of being recessed from the outer surface of the body 161 and protruded from the inner surface thereof.

Coupling pieces 170 may be protruded outwardly from the body 161 so as to be inserted into the unipolar locking unit 110, which allows the coupling of the elastic pressing unit 160 without use of a coupling member, such as a screw, and facilitates the fast coupling of the elastic pressing unit 160 due to the reduction of the number of coupling members required.

The coupling pieces 170 may be protruded outwardly (i.e., in widthwise direction) from the both side plate portions 163 and the connection portion 165 of the body 161. Insertion portions 115 in which the coupling pieces 170 are inserted may be formed at the unipolar blocking unit 110.

With such configuration, when manipulating the handle 145 to the closing position, the rotation pin 150 is rotated from the trip position to the closing position by the mechanical unit 140. During the downward rotation of the rotation pin 150, the guide portion 186*c* of the pusher 181 first comes in contact with the rotation pin 150. Accordingly, the pusher 181 is pressed into the body 161 to be moved inwardly (retracted), and the rotation pin 150 is downwardly rotated with being elastically contacted with the cut-off portion 186*a*.

When the rotation pin 150 is rotated toward the closing position, the pusher 181 is protruded by the elastic force of the pusher spring 191, to be thusly elastically contacted with the rotation pin 150, as shown in FIG. 10. Here, when the rotation pin 150 is rotated close to the closing position, the movable contacts 131 are moved close to the corresponding fixed contacts 121.

When the movable contacts 131 approach the fixed contacts 121, an electric repulsive force is generated and applied between the fixed contacts 121 and the movable contacts 131 in a direction of separating the movable contacts 131 from the fixed contacts 121. Here, the contact portion 186*b* formed at the pusher 181 comes in contact with the rotation pin 150 so as to press the rotation pin 150 downwardly, thereby preventing the deformation of the rotation pin 150 caused by the upwardly applied electric repulsive force.

In the meantime, when the rotation pin 150 is upwardly rotated from the closing position to the trip position, as shown in FIG. 11, the cut-off portion 186*a* of the pusher 181 is elastically pressed by being contacted with the rotation pin 150, as similar to the rotation of the rotation pin 150 toward the closing direction, and accordingly the pusher 181 is retracted into the body 161.

Hereinafter, another embodiment according to the present invention will be described with reference to FIG. 12.

Figure 12:
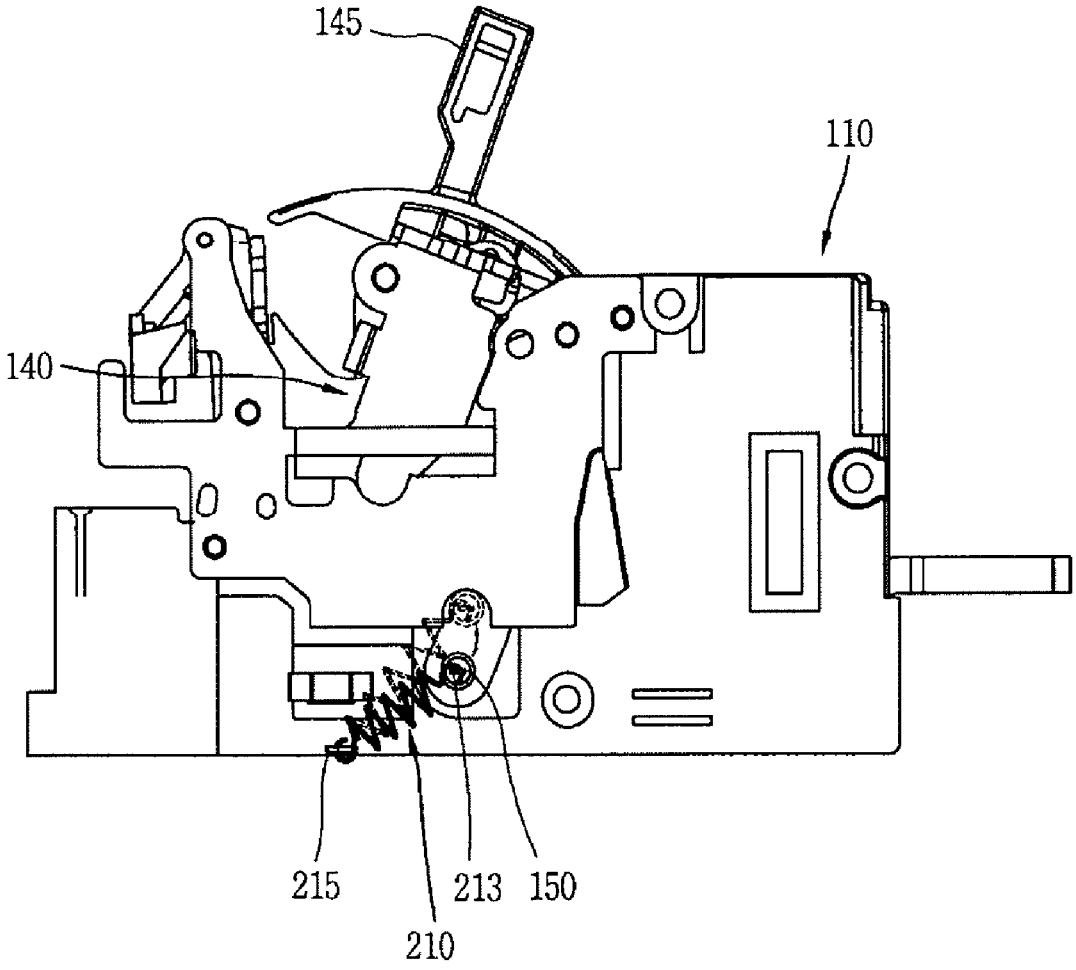
FIG. 12 is a side view showing an installed state of an elastic pressing unit in accordance with another embodiment of the present invention.

FIG. 12 is a side view showing an installed state of an elastic pressing unit in accordance with another embodiment of the present invention. As shown in FIG. 12, a molded case circuit breaker having an elastic pressing unit in accordance with another embodiment of the present invention may include a plurality of fixed contacts 121, a plurality of movable contacts 131 disposed to be rotatable between a closing position contacted with corresponding fixed contacts 121 and a breaking position (or a trip position) separated from the corresponding fixed contacts 121, a rotation pin 150 simultaneously connected to the movable contacts 131, a mechanical unit 140 connected to the rotation pin 150 for allowing the movable contacts 131 to be simultaneously rotated, and an elastic pressing unit 210 for applying an elastic force to the rotation pin 150 to be rotated to the closing position. Here, the fixed contact 121 and the movable contact 131 may be configured as a pair, and each pair of the fixed contact 121 and the movable contact 131 may implement a unipolar blocking unit 110 for controlling each phase current.

The elastic pressing unit 210 may be implemented as a spring disposed at one side of the rotation pin 150 for applying an elastic force to the rotation pin 150 in a direction toward a closing position. In this embodiment, the spring is implemented as a tension coil spring.

A spring hook 213 at which one end of the spring is hooked may be formed at one side of the rotation pin 150. A spring fixing portion 215 to which another end of the spring is hooked may be formed at the frame 111 of the unipolar blocking unit 110. Here, one end of the elastic pressing unit 210, namely, one end of the spring may be provided with a ring (hook) (not shown), which is fixedly hooked at a circumferential surface of the rotation pin 150.

The elastic pressing unit 210 may be connected in a tensioned state so as to apply a prescribed elastic force in a direction for rotating the rotation pin 150 toward the closing position.

Here, the elastic pressing unit 210, namely, the spring may be disposed at an end (or near the end) of the rotation pin 150, which is farther away from the mechanical unit 140. Alternatively, the elastic pressing unit 210 may be installed at both ends of the rotation pin 150. The elastic force or the number of the elastic pressing unit 210 may appropriately be adjusted.

With such configuration, when the rotation pin 150 is rotated toward the closing position and accordingly the movable contacts 131 approach the corresponding fixed contacts 121, an electric repulsive force is generated between the two contacts. Here, the elastic pressing unit 210, namely, the spring applies an elastic force in a direction for rotating the rotation pin 150 toward the closing position, thereby attenuating or reducing the electric repulsive force, resulting in preventing the rotation pin 150 from being deformed due to the electric repulsive force.

The aforesaid and shown embodiments illustrate that only one elastic pressing unit is installed; however, the number of elastic pressing units may be to properly adjusted.

Further, in the embodiment described in relation to FIG. 12, the elastic pressing unit is implemented as the tension coil spring; however, it may be implemented as other types of springs, for example, a compression coil spring, a torsion spring and the like.

As described above, in accordance with one embodiment of the present invention, an elastic force is applied to a rotation pin so as to prevent deformation of the rotation pin due to an electric repulsive force between contacts. Accordingly, a driving force of a mechanical unit can be applied directly to movable contacts, resulting in ensuring operation reliability and stability of the mechanical unit.

Also, a contact pressure between the movable contacts and fixed contacts upon applying a current can be increased so as to enable a stable contact between the contacts, resulting in improving reliability of the molded case circuit breaker and extending a lifespan thereof.

Further, an elastic pressing unit can be configured by being provided with a body, a pusher and a spring, thereby simplifying the configuration and facilitating fabrication thereof.

In addition, a plurality of coupling pieces are formed by being protruded outwardly from the body of the elastic pressing unit and insertion portions in which the coupling pieces are inserted are formed at the elastic pressing unit, thereby allowing a fast and easy assembly (or installation) owing to non-use of separate components or reduction of the number of coupling members.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A molded case circuit breaker having an elastic pressing unit, the circuit breaker comprising:

a plurality of fixed contacts;

a plurality of movable contacts disposed to be rotatable between a closing position contacted with the corresponding fixed contacts and a breaking position or trip position separated from the corresponding fixed contacts;

a rotation pin disposed to be simultaneously connected to the movable contacts;

a mechanical unit connected to the rotation pin so as to allow the movable contacts to be simultaneously rotatable; and an elastic pressing unit configured to apply an elastic force to the rotation pin such that the rotation pin is rotated toward the closing position.

2. The circuit breaker of claim 1, wherein the elastic pressing unit comprises a pusher configured to press the rotation pin, and a spring configured to apply an elastic force to the pusher such that the pusher is contactable with the rotation pin.

3. The circuit breaker of claim 2, wherein the spring is a compression spring disposed at a rear side of the pusher.

4. The circuit breaker of claim 2, wherein the elastic pressing unit further comprises a body configured to slidably support the pusher.

5. The circuit breaker of claim 4, wherein the body is provided with an accommodation space, the pusher being protruded from and retracted into the accommodation space.

6. The circuit breaker of claim 5, wherein the elastic pressing unit further comprises guide pins coupled to the body and configured to not only slidably guide the pusher but also prevent the separation of the pusher.

7. The circuit breaker of claim 2, wherein the pusher is disposed above the closing position of the rotation pin.

8. The circuit breaker of claim 7, wherein the pusher is provided with a cut-off portion, cut out to correspond to a rotation route of the rotation pin.

9. The circuit breaker of claim 8, wherein a contact portion is formed at one side of the cut-off portion, the contact portion being formed by cutting out the one side to correspond to the shape of the rotation pin so as to be contactable with the rotation pin.

10. The circuit breaker of claim 1, wherein the elastic pressing unit is configured as a spring.

11. The circuit breaker of claim 10, wherein the spring is a tension spring having one side connected to the rotation pin and another side fixed to a fixed component.

12. The circuit breaker of claim 11, wherein the spring is disposed at each of both end portions of the rotation pin.

13. The circuit breaker of claim 1, wherein the fixed contacts and the movable contacts implement unipolar blocking units, each disposed by each phase.

14. The circuit breaker of claim 13, wherein the elastic pressing unit is disposed at a unipolar blocking unit located the farthest away from the mechanical unit.

15. An elastic pressing unit comprising:

a body;

a pusher coupled to be protruded from or retracted in the body; and a spring configured to apply an elastic force to the pusher so that the pusher is protruded, wherein the pusher is disposed to press a rotation pin in a direction that a plurality of movable contacts disposed in a shaft direction with a gap therebetween are contactable with fixed contacts, the rotation pin simultaneously coupled to the plurality of movable contacts.

16. The elastic pressing unit of claim 15, further comprising:

guide pins coupled to the body through the pusher and configured to not only guide the pusher but also prevent the separation of the pusher.

17. The elastic pressing unit of claim 15, wherein the body is provided with a plurality of coupling pieces protruded to be inserted into a frame of a unipolar blocking unit.

* * * * *